US011002005B2

(12) United States Patent
Hwang et al.

(10) Patent No.: US 11,002,005 B2
(45) Date of Patent: May 11, 2021

(54) INSERT FOR CONSTRUCTION SLAB

(71) Applicant: MAKESOON INC., Busan (KR)

(72) Inventors: Jong Wook Hwang, Busan (KR); Han Chan Kim, Busan (KR); Hang Jun Lee, Busan (KR); Hyeong Min Jung, Busan (KR)

(73) Assignee: MAKESOON INC., Busan (KR)

( * ) Notice: Subject to any disclaimer, the term of this patent is extended or adjusted under 35 U.S.C. 154(b) by 29 days.

(21) Appl. No.: 16/607,972

(22) PCT Filed: Apr. 12, 2018

(86) PCT No.: PCT/KR2018/004261
§ 371 (c)(1),
(2) Date: Oct. 24, 2019

(87) PCT Pub. No.: WO2018/212460
PCT Pub. Date: Nov. 22, 2018

(65) Prior Publication Data

US 2021/0102371 A1 Apr. 8, 2021

(30) Foreign Application Priority Data

May 19, 2017 (KR) ..... 10-2017-0062181

(51) Int. Cl.
*E04B 1/41* (2006.01)

(52) U.S. Cl.
CPC ..... *E04B 1/415* (2013.01)

(58) Field of Classification Search
CPC ..... E04B 1/415; E04B 1/4121; E04B 1/4135; E04B 1/4157; E04B 2001/2688
See application file for complete search history.

(56) References Cited

U.S. PATENT DOCUMENTS 2,988,855 A * 6/1961 Asfour ..... E04B 1/415 52/711
3,042,161 A * 7/1962 Meyer, Jr. ..... E21D 17/00 52/166

(Continued)

FOREIGN PATENT DOCUMENTS

JP 2004-034482 A 2/2004
KR 10-2009-0113476 A 11/2009

(Continued)

OTHER PUBLICATIONS

International Search Report for PCT/KR2018/004261 dated Jul. 27, 2018 from Korean Intellectual Property Office.

*Primary Examiner* — James M Ference
(74) *Attorney, Agent, or Firm* — Paratus Law Group, PLLC

(57) ABSTRACT

Disclosed is an insert for a construction slab which includes: main body in which an operation space having a planar cross-section of a polygonal shape in an axial direction is formed; a support block which is formed at a lower side of the main body to have a diameter smaller than that of the main body and has a withdrawal hole at an inner side thereof so that a support stepped portion is formed at a lower end of the operation space; a support plate formed at the lower side of the support block to be in contact with a mold; a cover member coupled to an upper portion of the main body so as to seal the operation space; and an anchor bolt member inserted into the operation space to be pressed to the withdrawal hole by a spring member.

9 Claims, 11 Drawing Sheets

(56) References Cited

U.S. PATENT DOCUMENTS 3,333,388 A * 8/1967 Sandin ..... E04B 1/41 52/701
3,640,328 A * 2/1972 Tummarello ..... F16B 37/04 411/103
3,715,851 A * 2/1973 Bennett ..... F16B 35/00 52/707
3,769,774 A * 11/1973 Barnes ..... F16L 3/14 52/698
4,084,780 A * 4/1978 Mess ..... B28B 23/005 249/177
4,106,745 A * 8/1978 Carrow ..... B22C 9/064 249/97
4,497,152 A * 2/1985 Weissner ..... E04H 4/141 119/790
5,042,888 A * 8/1991 Shinjo ..... F16B 13/0858 411/54
5,205,690 A * 4/1993 Roth ..... E04B 1/4121 411/180
5,257,490 A * 11/1993 Endo ..... E04F 13/0835 52/506.05
5,338,139 A * 8/1994 Swanstrom ..... F16B 5/0208 411/107
5,428,936 A * 7/1995 Roth ..... E04B 1/4157 248/327
5,468,105 A * 11/1995 Iwamoto ..... E04B 1/4121 411/433
5,522,688 A * 6/1996 Reh ..... E04B 1/0007 411/536
5,542,225 A * 8/1996 Endo ..... E04F 13/045 52/511
5,568,711 A * 10/1996 Popp ..... E01B 9/10 52/704
5,653,078 A * 8/1997 Kies ..... E04B 1/4121 52/698
6,240,697 B1 * 6/2001 Thompson ..... E04B 1/4121 52/698
6,792,734 B2 * 9/2004 Zambelli ..... B28B 23/005 52/125.1
7,093,400 B1 * 8/2006 Thompson ..... E04B 9/18 52/698
7,752,824 B2 * 7/2010 Brown ..... F16B 21/16 52/745.21
8,186,924 B1 * 5/2012 Espinosa ..... E04B 1/2604 411/536
8,201,381 B2 * 6/2012 Heath ..... E04B 1/4157 52/745.21
8,453,412 B2 * 6/2013 Toedte ..... E04B 1/415 52/699
9,181,691 B2 * 11/2015 Thompson ..... F16L 3/00
9,347,232 B1 * 5/2016 Francies, III ..... E04G 15/04
9,567,741 B2 * 2/2017 Espinosa ..... E04B 1/40
2003/0208969 A1 * 11/2003 Lancelot, III ..... E04G 21/142 52/125.4
2013/0047546 A1 * 2/2013 Toedte ..... E04B 1/415 52/699
2013/0067849 A1 * 3/2013 Espinosa ..... E04B 1/4121 52/699
2013/0104483 A1 * 5/2013 Hensley ..... F16B 35/04 52/466
2014/0026515 A1 * 1/2014 Espinosa ..... E04B 1/4171 52/700
2014/0053475 A1 * 2/2014 Siqueiros ..... E01C 23/10 52/125.1
2014/0157717 A1 * 6/2014 Espinosa ..... E04B 1/4114 52/700
2015/0096242 A1 * 4/2015 Lin ..... F16B 5/0275 52/125.5
2016/0326738 A1 * 11/2016 Lin ..... F16B 37/00

FOREIGN PATENT DOCUMENTS

KR 10-1001898 B1 12/2010
KR 10-1493249 B1 2/2015
KR 20-0481370 Y1 9/2016
WO WO 96/06992 A1 3/1996

* cited by examiner

INSERT FOR CONSTRUCTION SLAB

CROSS-REFERENCE TO PRIOR APPLICATIONS

This application is a National Stage Patent Application of PCT International Patent Application No. PCT/KR2018/004261 (filed on Apr. 12, 2018) under 35 U.S.C. § 371, which claims priority to Korean Patent Application No. 10-2017-0062181 (filed on May 19, 2017), which are all hereby incorporated by reference in their entirety.

BACKGROUND

The present invention relates to an insert for a construction slab, and more particularly, to an insert for a construction slab, in which the insert can be commonly used in a plywood mold, an aluminum (steel) mold, and a deck plate (hereinafter, referred to as a 'mold') and provides functionality for allowing an embedded anchor bolt member to be withdrawn to the outside when removing the mold, thereby eliminating an inconvenience of separately assembling the anchor bolt member after mold removal.

In general, when a concrete slab or wall, such as a ceiling of a building, is constructed, a net type insert is embedded and installed in the concrete slab or wall to hang and install structures from the ceiling.

The insert for the slab is applied to a general plywood mold or aluminum mold and various prior arts have been proposed.

As a representative example of the insert for the slab, there is provided an insert for a concrete slab in Korean Patent Publication No. 10-2009-0113476 A (Nov. 2, 2009). In an insert for a concrete slab embedded and installed in a concrete, a configuration thereof is characterized by including an insert main body in which a net body is embedded; an insertion tube which is extend downward of the insert main body and inserted and coupled with an anchor bolt; an elastic piece which is extended downward of the insertion tube and formed to be elastically shaft-diameter; and an engaging portion which is formed at an end of the elastic piece and protrudes outwardly to be engaged to a bottom surface of a fitting hole formed in the mold of the concrete.

Such a configuration may install the insert by a simple operation of coupling the insert main body to the mold in one touch, and thus the construction is very simple. In addition, a component for installing the insert does not remain on the mold even if the mold is removed, and thus the insert may be permanently recycled without a need of changing the structure of the mold.

As another example, there is proposed an insert for a concrete slab of Korean Patent Registration No. 10-1493249 B (Feb. 13, 2015). A configuration thereof is constituted by a connection pipe detachably coupled to a connection end of a cylindrical body and a cover coupled to an anchor nut insertion portion. The connection pipe includes a head portion in which a passage through which the anchor bolt may pass is formed and an anchor nut is embedded, a cylindrical guide portion in which a body in which a passage into which the anchor bolt is inserted is formed and uneven portions are radically formed on a lower inner surface of the body, and a conical tip portion in which a radical uneven portion detachably coupled to the uneven portion is formed and a tip pin is mounted on the end, wherein the head portion, the guide portion, and the tip end portion are detachably coupled to each other. In the insert for the concrete slab, a plurality of protrusions is constituted to protrude at regular intervals on a peripheral of an upper outer surface of the body and a conical screw portion having a screw thread is configured on the conical tip portion.

According to the prior art, since the insert may be conveniently and easily embedded by a structure to be rotatably embedded and the conical tip portion, an improved effect of reducing manpower, time, and cost required for an insert embedded construction is achieved. Alternatively, even in the case of a standard change of the anchor bolt coupled to the insert, the anchor nut may be easily replaced by a structure of a self-assembly insert for the concrete slab.

However, the configuration has an inconvenience to fasten the anchor bolt to the anchor nut which is embedded while the mold is separated.

Therefore, in the industry, an insert of a configuration usable with an anchor bolt is required without an operation such as assembling an anchor bolt separately after the mold is separated.

SUMMARY

Therefore, the present inventors researched and developed the present invention to eliminate an inconvenience of an operation of assembling an anchor bolt member prepared separately after removing the mold to an insert by using an insert for a construction slab for fixing construction finishing materials (ceiling panel or wall panel) when a concrete is deposited to construct a slab or wall (or construct the wall) while a reinforcing bar is reinforced to the upper side of the mold as described above.

That is, an object of the present invention is to provide an insert for a construction slab in which an operation space is formed in a main body configuring an insert, a bolt head provided with an anchor bolt member or a fastened nut member is located in the operation space to be elastically supported by a spring member, so that the anchor bolt member is withdrawn to the outside through a withdrawal hole formed in a support block at the lower side of the main body while the mold is removed, thereby eliminating an inconvenience such as assembling the anchor bolt member separately after the mold is removed. Therefore, the present inventors completed the present invention.

As a technical solution, first, the present invention includes: main body in which an operation space having a planar cross-section of a polygonal shape in an axial direction is formed; a support block which is formed at a lower side of the main body to have a diameter smaller than that of the main body and has a withdrawal hole at an inner side thereof so that a support stepped portion is formed at a lower end of the operation space; a support plate formed at the lower side of the support block to be in contact with a mold; a cover member coupled to an upper portion of the main body so as to seal the operation space; and an anchor bolt member inserted into the operation space to be pressed to the withdrawal hole by a spring member.

Second, the anchor bolt member may be formed integrally with a bolt head at an upper end of a screw rod.

Third, the anchor bolt member may be configured by a full threads bolt and fastened with a nut member to control a height.

Fourth, the support block may have a length corresponding to a thickness of an insulator located at a lower side of a slab or wall.

Fifth, in the support plate, a plurality of fixing holes may be formed to fix the support plate to the mold by a fixing means such as pieces or nails.

Sixth, a head-in inlet to which a head of an insert fixture fixed to the mold is inserted may be formed at the lower side of the support plate.

Seventh, in the main body, locking grooves may be formed so that a nut member coupled to the bolt head or the full threads bolt formed at the upper end of the screw rod is inserted and locked to control the length of the anchor bolt member withdrawn through the withdrawal hole.

Eighth, cutting grooves may be formed outside the main body to control the length of the main body.

Ninth, the anchor bolt member may include a fixing nut member which is fastened to the anchor bolt member to fix the anchor bolt member while the mold is removed.

Tenth, in the anchor bolt member, an extended screw rod may be connected to an end of the anchor bolt member using a connector while the mold is removed.

The insert for the construction slab provided in the present invention has the following effects.

- The insert for the construction slab has a configuration in which a fixing hole is formed in a support plate and a head-in inlet is formed at a lower side of the support plate to be used for a mold.
- While the anchor bolt member is embedded, the anchor bolt member is withdrawn through the withdrawal hole formed in the support block when the mold is removed, thereby eliminating an inconvenience such as assembling the anchor bolt member separately.
- By a method of fastening the fixing nut member to the anchor bolt member withdrawn to the lower side of the support block, the length of the anchor bolt member may be easily controlled to provide a firm fixing state of the anchor bolt member.
- The locking grooves are formed in the main body to easily control the length of the anchor bolt member exposed to the outside through the withdrawal hole.
- It is possible to easily control the length of the main body using cutting grooves formed outside the main body in multiple stages.
- The support block is elongated to be usable for a slab or wall to which an insulator is applied.

DETAILED DESCRIPTION

Hereinafter, preferred embodiments of an insert for a construction slab provided in the present invention will be described with reference to the accompanying drawings.

Figure 1:
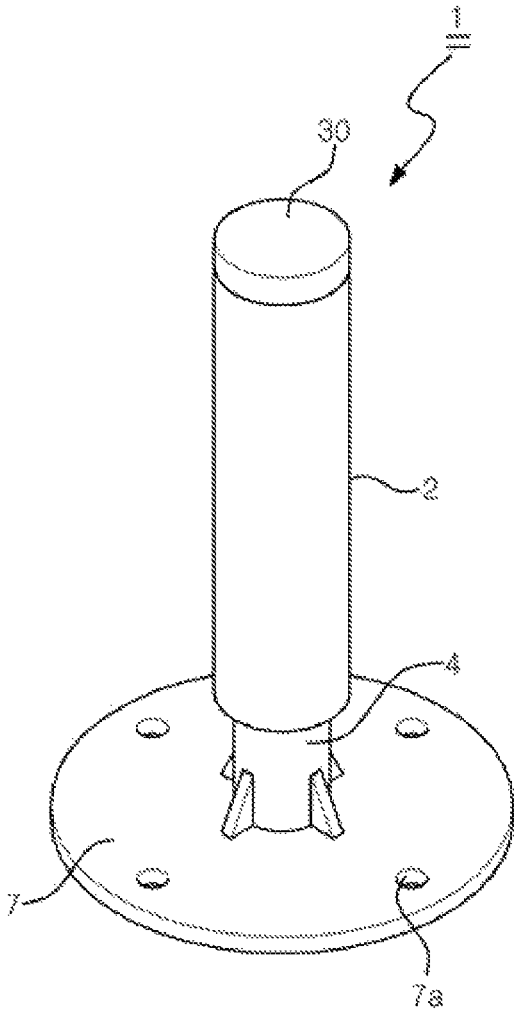
FIG. 1 is a perspective view of a first preferred embodiment of an insert for a construction slab provided in the present invention.
Figure 2:
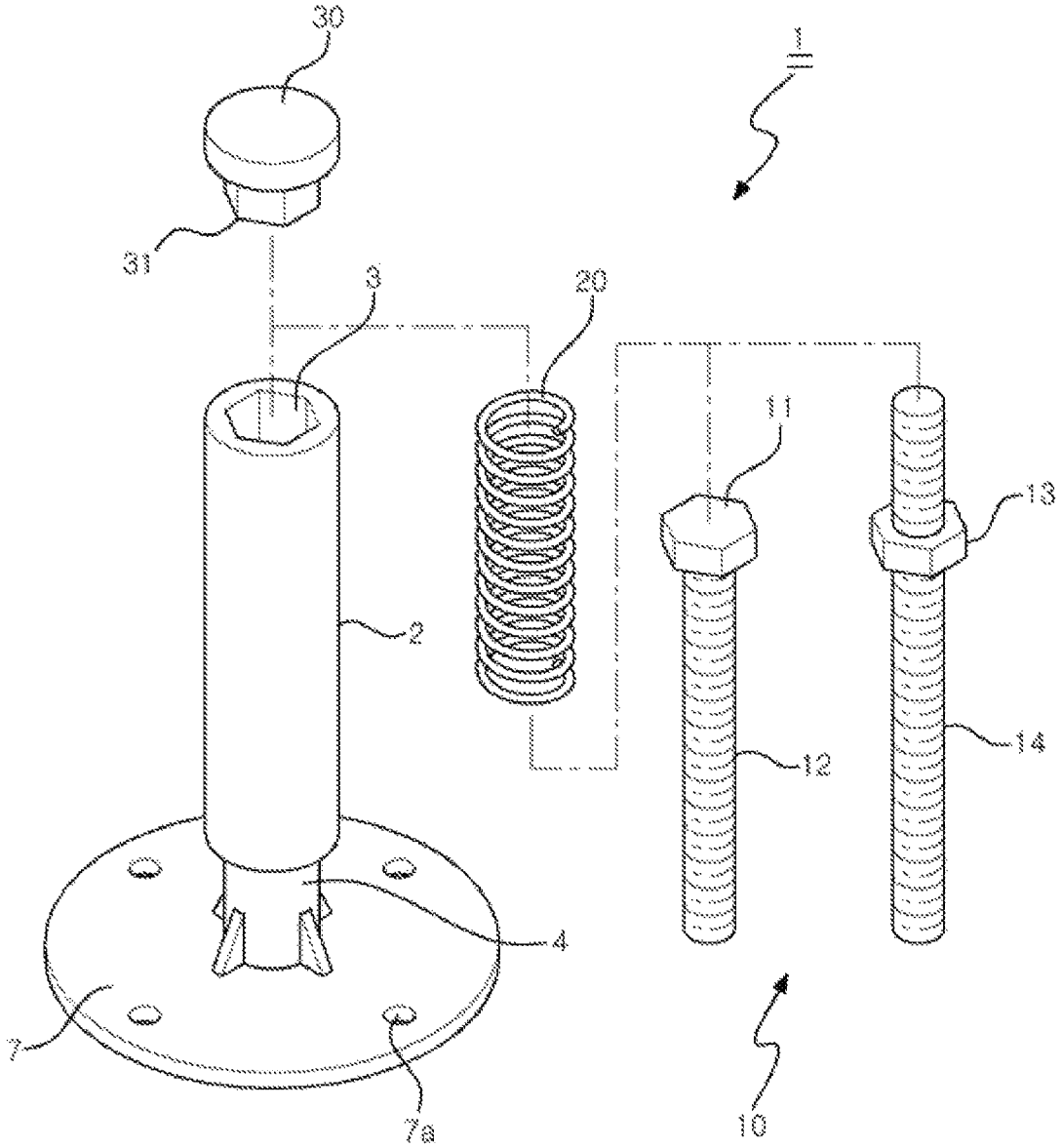
FIG. 2 is an exploded perspective view of FIG. 1.
Figure 3:
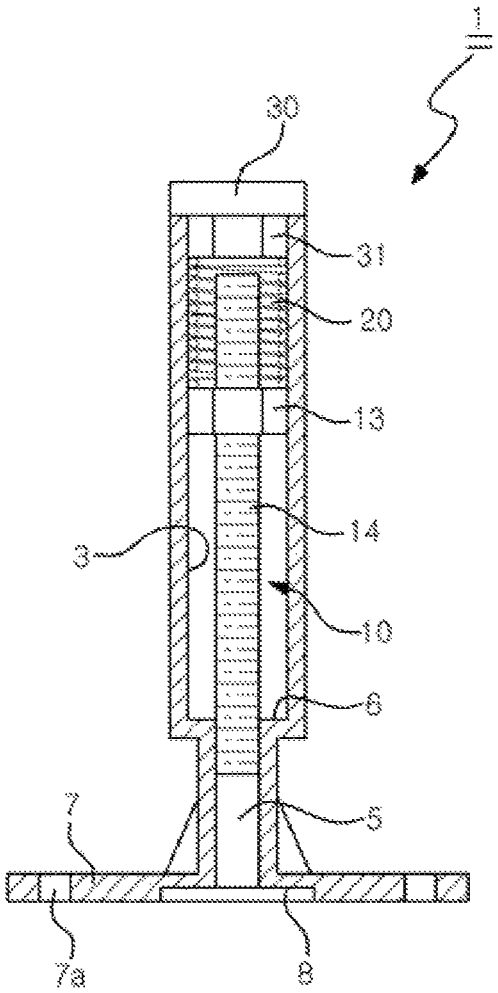
FIG. 3 is a cross-sectional view of an assembly state of FIG. 1.
Figure 4:
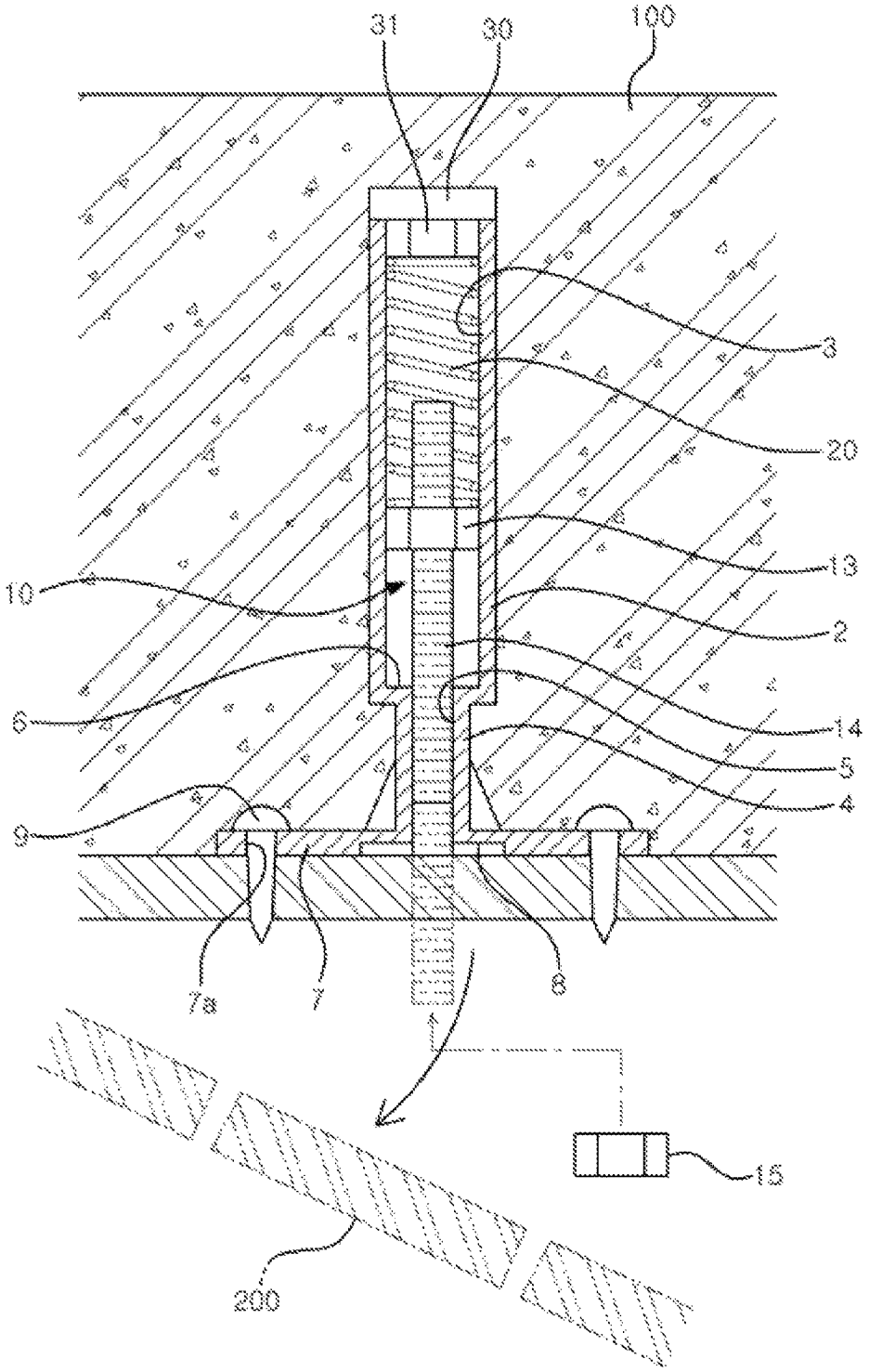
FIG. 4 is a cross-sectional view of a state in which the present invention is applied to a plywood mold.
Figure 5:
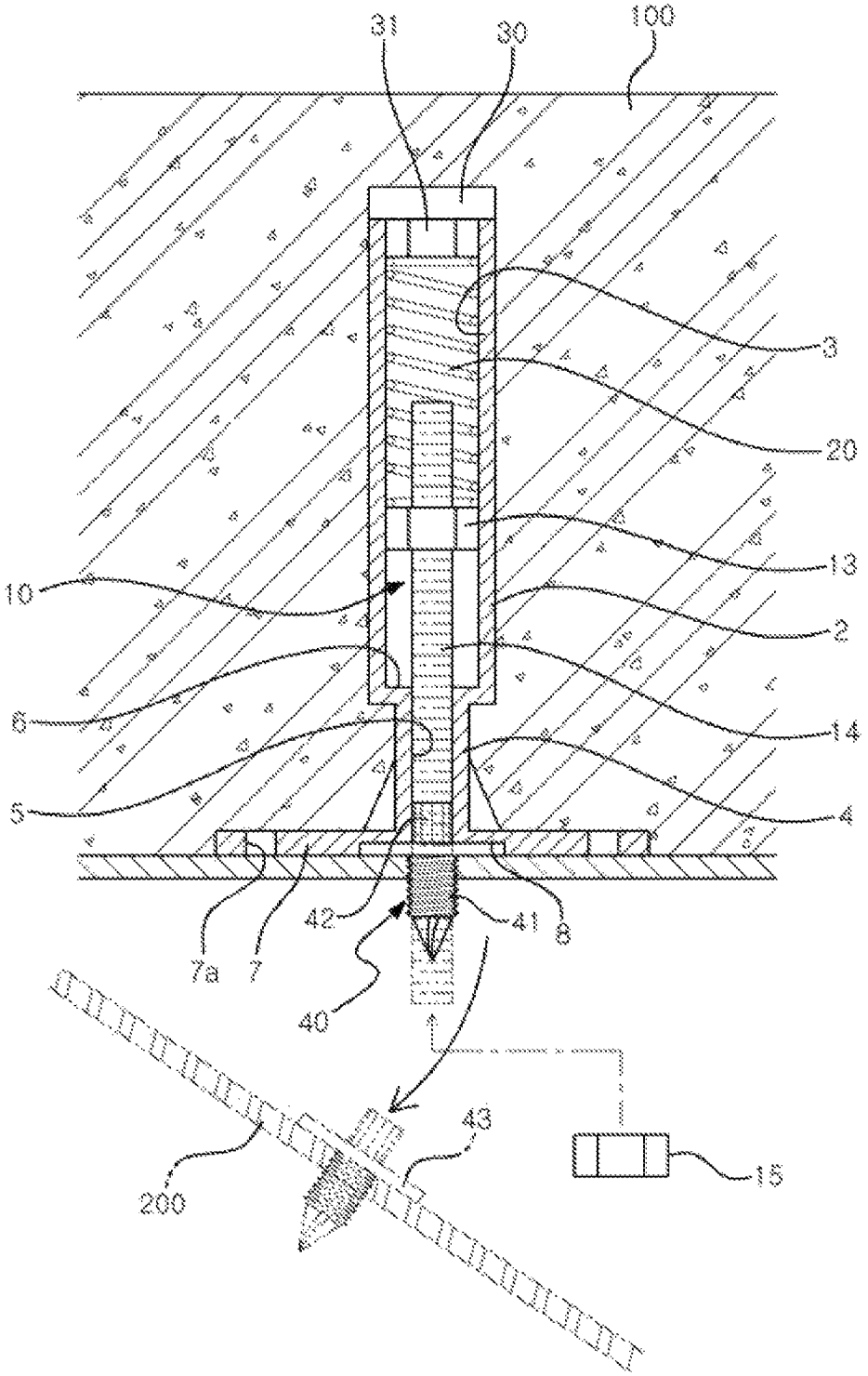
FIG. 5 is a cross-sectional view of a state in which the present invention is applied to an aluminum mold.

FIG. 1 is a perspective view of a first preferred embodiment of an insert for a construction slab provided in the present invention, FIG. 2 is an exploded perspective view of FIG. 1, FIG. 3 is a cross-sectional view of an assembly state of FIG. 1, FIG. 4 is a cross-sectional view of a state in which the present invention is applied to a plywood mold, and FIG. 5 is a cross-sectional view of a state in which the present invention is applied to an aluminum mold.

An insert 1 for a construction slab provided in the present invention may be applied commonly to a slab or wall 100 of a construction and is used for performing the construction while an anchor bolt for fixing a construction finishing material such as a ceiling panel or a wall panel is not separately constructed.

Particularly, the insert 1 for the construction slab provided in the present invention embeds an anchor bolt member 10 to be withdrawn to the outside by elasticity of a spring member 20 while removing a mold 200, thereby eliminating an inconvenience such as assembling the anchor bolt member 10 separately.

To this end, the present invention is constituted by a main body 2, an anchor bold member 10, a spring member 20, and a cover member 30.

The main body 2 has an operation space 3 formed inside, and the operation space 3 is configured to have a depth capable of accommodating the anchor bold member 10 in an axial direction. When viewed from a planar cross-section, the main body 2 is formed in a polygonal shape corresponding to a shape of a bolt head 11 of the anchor bold member 10 or a nut member 13 coupled to the anchor bold member 10. As shown in the drawings, the bolt head 11 or the nut member 13 is formed in a hexagonal shape and a planar cross-section of the operation space 3 is formed in a hexagonal shape. The operation space 3 is formed in a size larger than the bolt head 11 or the nut member 13 so that the nut member 13 may naturally ascend.

The operation space 3 has a configuration which is sealed by the cover member 30 assembled at the main body 2. The main body 2 and the cover member 30 are constituted by a configuration protruding from a fixing portion 31 downward of the cover member 30 to be tightly fitted to the operation space 3 formed in the main body 2 as an assembling method.

At the lower side of the main body 2, a support block 4 having a smaller diameter than the main body 2 is integrally formed with the main body 2. At the inner side of the support block 4, a withdrawal hole 5 through which the anchor bolt member 7 may be withdrawn in an axial direction is formed, and a support stepped portion 6 is formed on a boundary between the operation space 3 and the withdrawal hole 5 to support the anchor bolt member 10 while moving downwardly.

At the lower side of the support block 4, a wide flat support plate 7 is provided integrally with the support block 4, and a plurality of fixing holes 7*a* are formed at edges of the support plate 7 to tightly fix the support plate 7 to the plywood mold 200 by a fixing means 9 such as nails or pieces (see FIG. 4).

Further, at the lower side of the support plate 7, a head-in inlet 8 is formed to be located at a lower end of the withdrawal hole 5 to be used for the aluminum type mold 200 (see FIG. 5).

The aluminum mold 200 is mainly used when constructions having the same interior space such as apartments or office buildings are built, and the aluminum mold 200 has a configuration coupled with an insert fixture 40 for fixing the insert 1 for the slab in place.

The insert fixture 40 is constituted by forming a fastening screw portion 41 fixed to the mold 200 and a head 42 extending to an upper side of the fastening screw portion 41 and forming a locking piece 43 on a boundary between the fastening screw portion 41 and the head 42.

In the present invention, the head-in inlet 8 is referred to as a groove formed on the support plate 7 so that the locking piece 43 is inserted while the head 42 is inserted into the withdrawal hole 5.

Meanwhile, as described above, the anchor bolt member 10 is embedded in the operation space 3, and the spring member 20 is disposed between the upper side of the anchor bolt member 10 and the cover member 30 to press the anchor bolt member 10 toward the withdrawal hole 5. At this time, in the anchor bolt member 10 applied to the present invention, the bolt head 11 is integrally formed at an upper end of the screw rod 12 or a configuration of fastening the nut member 13 to a full threads bolt 14.

In the former, it is difficult to control the length of the anchor bolt member 10, but in the latter, the nut member 13 assembled to the full threads bolt 14 moves upward or downward to provide a convenience in use by variously controlling a length exposed to the outside while the mold 200 is removed.

Meanwhile, in the present invention, while the mold 200 is removed, the fixing nut member 15 is fastened to the anchor bolt member 10 withdrawn to the lower side of the insert 1 for the slab so as to firmly fix the anchor bolt member 10 without shaking.

Figure 6:
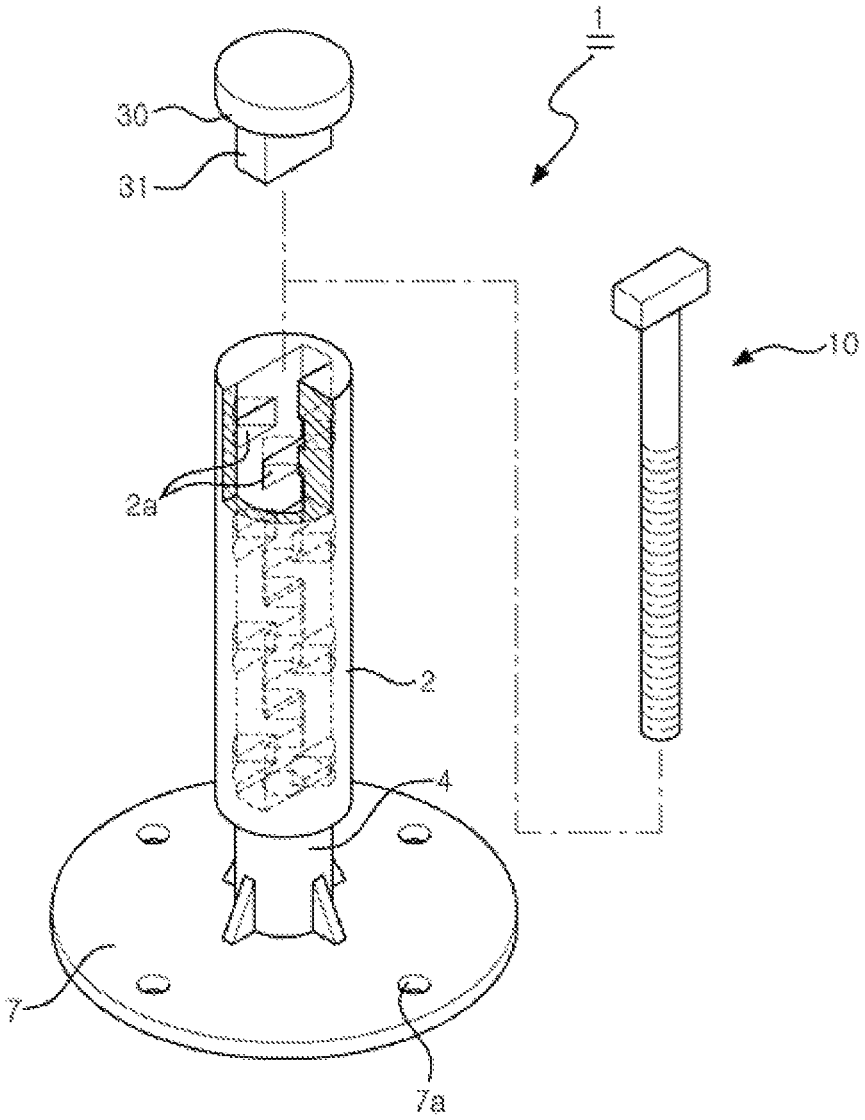
FIG. 6 is a perspective view showing a state in which a locking groove is formed on the inside of a main body in the present invention.
Figure 7:
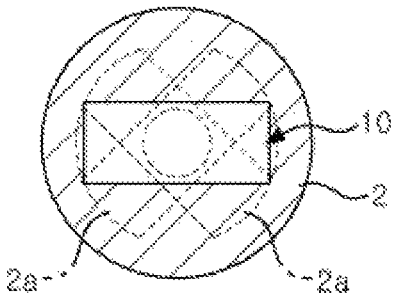
FIG. 7 is a cross-sectional view and a plan view of FIG. 6.

FIG. 6 is a perspective view showing a state in which a locking groove is formed on the inside of a main body in the present invention and FIG. 7 is a cross-sectional view and a plan view of FIG. 6.

When configuring the present invention as described above, locking grooves having different heights are formed in the main body 2 so that the bolt head 11 of the anchor bolt member 10 or the nut member 13 coupled to the anchor bolt member 10 may be inserted, thereby controlling a withdrawal length of the screw rod 12 or the full threads bolt 14.

In other words, in FIGS. 6 and 7, the bolt head 11 or the nut member 13 has a rectangular shape, the operation space 3 formed inside the main body 2 is formed in a rectangular shape like the bolt head 11 or the nut member 13. While the operation space 3 is distorted, the locking grooves 2*a* are formed in multiple stages so that the bolt head 11 or the nut member 13 are inserted and locked when the screw rod 12 withdrawn through the withdrawal hole 5 or the full threads bolt 14 rotates at the height of the locking groove 2*a*, thereby controlling a withdrawal length of the screw rod 12 withdrawn through the withdrawal hole 5 or the full threads bolt 14.

Figure 8:
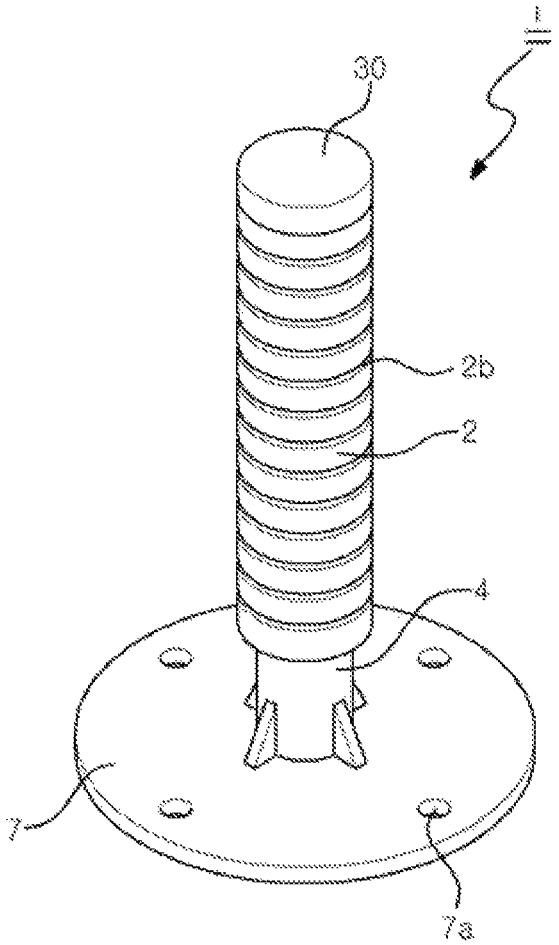
FIG. 8 is a perspective view showing a state in which a cutting groove is formed on the outside of the main body in the present invention.
Figure 9:
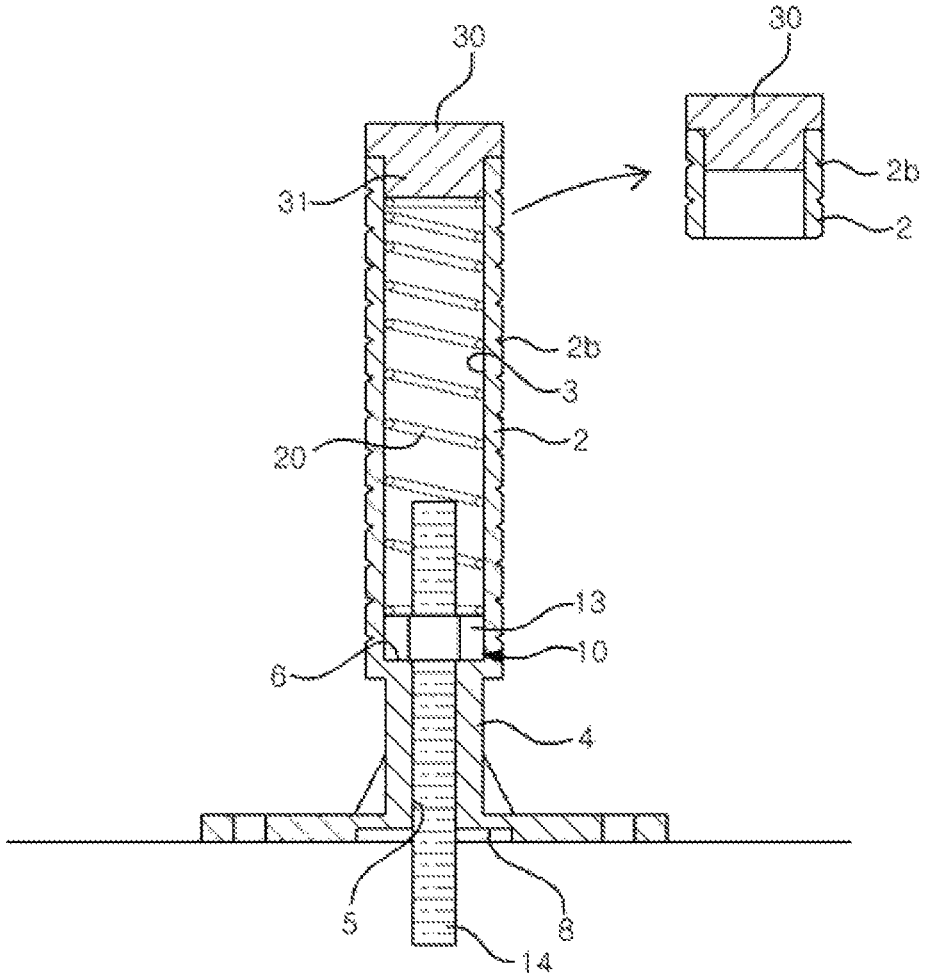
FIG. 9 is a cross-sectional view of FIG. 8.

FIG. 8 is a perspective view showing a state in which a cutting groove is formed on the outside of the main body in the present invention and FIG. 9 is a cross-sectional view of FIG. 8.

In the configuration described above, this is a configuration of forming cutting grooves 2*b* outside the main body 2 in multiple stages.

As described above, when the cutting groove 2*b* is formed on the main body 2, it is possible to provided functionality capable of controlling the length of the main body 2 so as to coincide with the thickness of the slab or wall 100.

That is, when controlling the length of the main body 2, first, while the cover member 30 assembled at the upper side of the main body 2 is separated, the main body 2 is controlled with a desired length using the cutting grooves 2*b* provided in multiple stages to reassemble the cover member 30 to the main body 2.

As described above, when the length of the main body 2 is controlled, even if the thickness of the slab or wall 100 varies in a design of the construction, it is possible to provide an effect of provide a convenience in use by simply controlling the length of the main body 2 in the field.

Figure 10:
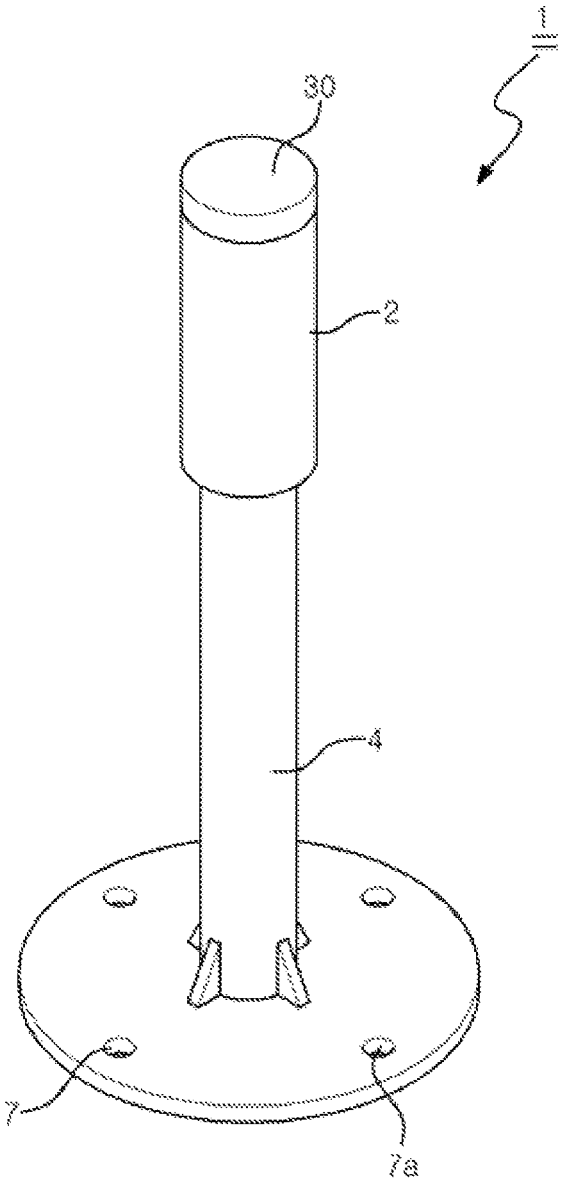
FIG. 10 is a perspective view showing a second preferred embodiment of an insert for a construction slab provided in the present invention.
Figure 11:
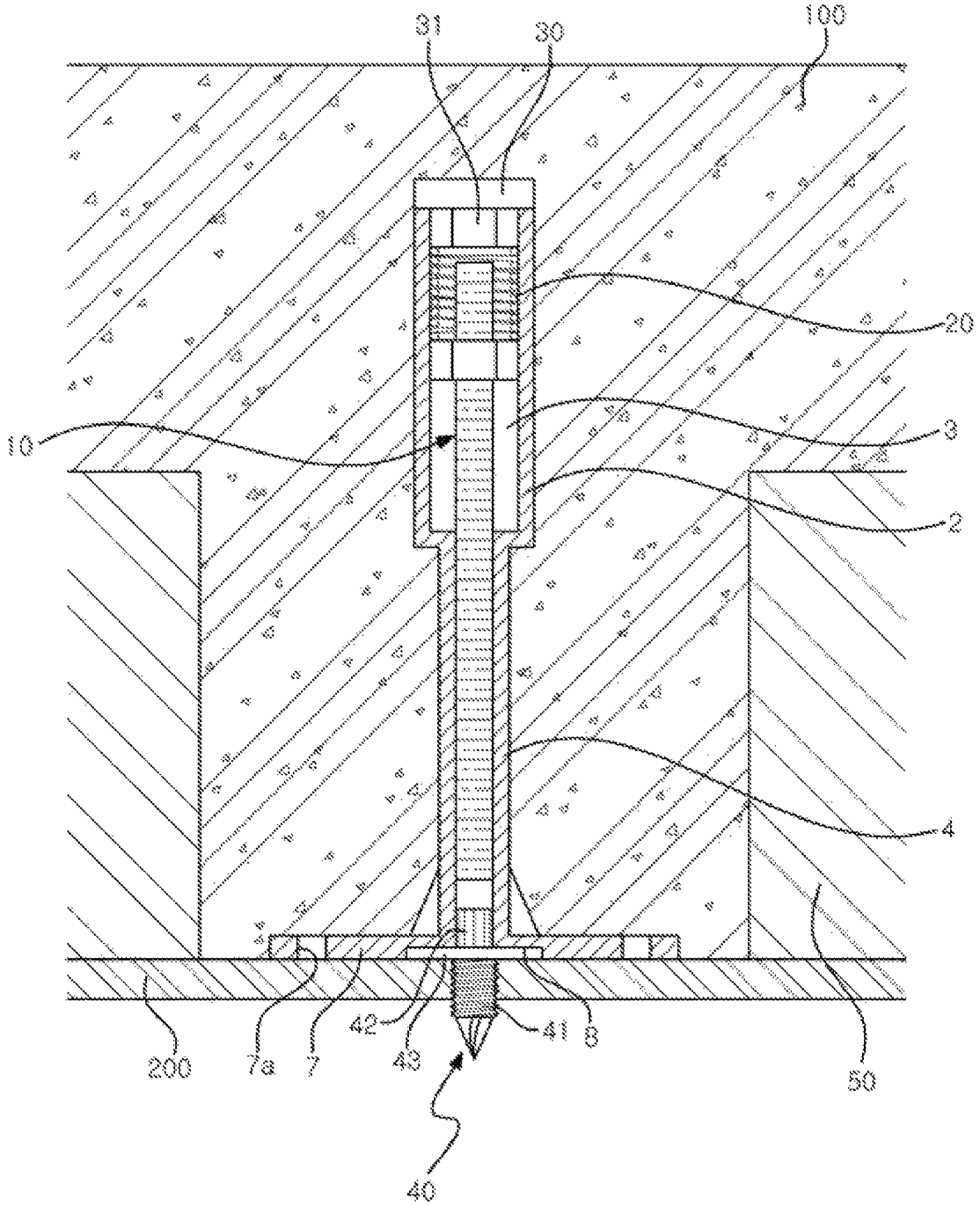
FIG. 11 is a cross-sectional view showing a used state of FIG. 10.

FIG. 10 is a perspective view showing a second preferred embodiment of an insert for a construction slab provided in the present invention and FIG. 11 is a cross-sectional view showing a used state of FIG. 10.

Like the first embodiment, when configuring the insert 1 for the construction slab, the support block 4 is elongated to have a length corresponding to a thickness of an insulator located at the lower side of the slab or wall 100. As shown in FIG. 9, while there is provided a configuration in which the support block 4 is located at an inner side of the insulator 50 and the support block 4 and the main body 2 located at the upper end of the support block 4 are embedded in the slab or wall 100, it is possible to provide firm fixation of the insert 1 for the slab of the present invention while the mold 200 at the lower side of the insulator 50 is separated.

Figure 12:
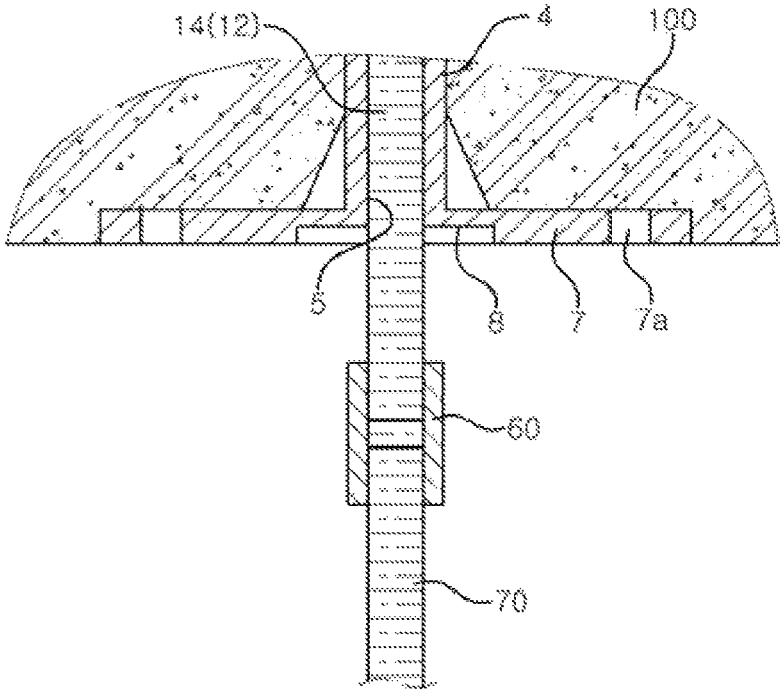
FIG. 12 is a cross-sectional view showing an example of connecting an extended screw rod to an anchor bolt member of the present invention.

FIG. 12 is a cross-sectional view showing an example of connecting an extended screw rod to an anchor bolt member of the present invention.

In the insert 1 for the construction slab provided in the present invention, the length of the anchor bolt member 10 is limited to the length corresponding to the operation space 3 inside the main body 2, and in some cases, it is necessary to elongate the anchor bolt member 10.

For example, when a space is highly provided between the ceiling panel and the slab or wall 100, the construction may not be performed with the anchor bolt member 10 provided in the present invention. As a method solving the problem, the full threads bolt 14 configuring the anchor bolt member 10 is separated from the nut member 13 and the full threads bolt 14 is reassembled with a length corresponding to the construction. In addition, as shown in the drawing, while a connector 60 is screw-coupled to the anchor bolt member 10, the extended screw rod 70 is fastened to the connector 60 to extend the length thereof.

The insert 1 for the construction slab of the present invention provided as such may be used commonly for the slab or wall 100, and when the mold 200 is separated, the anchor bolt member 10 embedded in the operation space 3 in the main body 2 is withdrawn to the outside by a pressing force of the spring member 20, thereby eliminating an inconvenience of assembling separately the full threads bolt 14 and the like.

In the detailed description of the present invention, specific embodiments are described, but various modifications are possible within limits without departing from the scope of the present invention. Therefore, the scope of the present invention should not be limited to the embodiments and should be defined by the appended claims to be described below and equivalents to the appended claims.

The invention claimed is:

1. An insert for a construction slab, comprising:

a main body in which an operation space having a planar cross-section of a polygonal shape in an axial direction is formed;

a support block which is formed at a lower side of the main body to have a diameter smaller than that of the main body and has a withdrawal hole at an inner side thereof so that a support stepped portion is formed at a lower end of the operation space;

a support plate formed at a lower side of the support block to be in contact with a mold;

a cover member coupled to an upper portion of the main body so as to seal the operation space; and an anchor bolt member inserted into the operation space to be pressed to the withdrawal hole by a spring member, and including a screw rod, and a bolt head internally formed with the screw rod at an upper end of the screw rod, the bolt head being movably inserted inside the operation space of the main body, wherein the support plate includes a flange extended outward from the lower side of the support block, and a head-in inlet formed at a bottom surface of the flange to have a diameter bigger than that of the withdrawal hole such that a head of an insert fixture fixed to the mold is upwardly inserted into the head-in inlet from a side lower than the flange.

2. The insert for a construction slab of claim 1, wherein the support block has a length corresponding to a thickness of an insulator located at a lower side of a slab or wall.

3. The insert for a construction slab of claim 1, wherein the support plate further includes a plurality of fixing holes formed to fix the support plate to the mold by a fixing means.

4. The insert for a construction slab of claim 1, wherein the main body includes locking grooves formed at an inside surface of the main body and arranged at different levels along the axial direction of the main body, wherein the bolt head has a shape corresponding to an inside shape of the main body such that the bolt head is able to move in the operation space along the axial direction of the main body, and wherein the bolt head is locked in a locking groove when the bolt head is rotated at a level where the locking groove is formed so that a length of the anchor bolt member withdrawn through the withdrawal hole is controlled by the level where the bolt head is locked by the locking groove.

5. The insert for a construction slab of claim 1, wherein the main body includes cutting grooves formed at an outer surface of the main body to control a length of the main body.

6. The insert for a construction slab of claim 1, wherein the anchor bolt member includes a fixing nut member which is fastened to the anchor bolt member to fix the anchor bolt member while the mold is removed.

7. The insert for a construction slab of claim 1, wherein in the anchor bolt member, an extended screw rod is connected to an end of the anchor bolt member using a connector while the mold is removed.

8. An insert for a construction slab, comprising:

a main body having an operation space penetrating the main body in an axial direction;

a support block which is formed at a lower side of the main body to have a diameter smaller than that of the main body and has a withdrawal hole at an inner side thereof so that a support stepped portion is formed at a lower end of the operation space;

a support plate formed at a lower side of the support block to be in contact with a mold;

a cover member coupled to an upper portion of the main body so as to seal the operation space; and an anchor bolt member inserted into the operation space to be pressed to the withdrawal hole by a spring member, wherein the anchor bolt member includes a full threads bolt and a nut member threaded onto the full threads bolts to control a height of the anchor bolt which is withdrawn through the withdrawal hole when the mold is removed, wherein the nut member is movably positioned inside the operation space of the main body.

9. The insert for a construction slab of claim 8, wherein the main body includes locking grooves formed at an inside surface of the main body and arranged at different levels along the axial direction of the main body, wherein the nut member threaded onto the full threads bolts has a shape corresponding to an inside shape of the main body such that the nut member is able to move in the operation space along the axial direction of the main body, and wherein the nut member is locked in a locking groove when the nut member is rotated at a level where the locking groove is formed so that a length of the anchor bolt member withdrawn through the withdrawal hole is controlled by the level where the bolt head is locked by the locking groove.

* * * * *